US009124004B2

(12) United States Patent
Rard

(10) Patent No.: US 9,124,004 B2
(45) Date of Patent: Sep. 1, 2015

(54) LOW PROFILE CONFORMING RADAR REFLECTOR

(71) Applicant: Roy Rard, Conway, WA (US)

(72) Inventor: Roy Rard, Conway, WA (US)

( * ) Notice: Subject to any disclaimer, the term of this patent is extended or adjusted under 35 U.S.C. 154(b) by 288 days.

(21) Appl. No.: 13/891,800

(22) Filed: May 10, 2013

(65) Prior Publication Data

US 2013/0300594 A1 Nov. 14, 2013

Related U.S. Application Data

(60) Provisional application No. 61/645,092, filed on May 10, 2012.

(51) Int. Cl.

| | |
|---|---|
| ***H01Q 15/18*** | (2006.01) |
| ***H01Q 1/34*** | (2006.01) |
| *H01Q 15/00* | (2006.01) |

(52) U.S. Cl.

CPC . *H01Q 15/18* (2013.01); *H01Q 1/34* (2013.01)

(58) Field of Classification Search

CPC ..... H01Q 1/27; H01Q 1/34; H01Q 15/14; H01Q 15/18; H01Q 15/20

USPC ..... 342/5–11; 313/110, 111; 156/1, 60, 156/242, 245; 359/515, 529–533, 549–552

See application file for complete search history.

(56) References Cited

U.S. PATENT DOCUMENTS

| | | | | | |
|---|---|---|---|---|---|
| 3,039,093 | A | * | 6/1962 | Rockwood | 342/7 |
| 3,200,400 | A | * | 8/1965 | Gill, Jr. | 342/7 |
| 3,310,804 | A | * | 3/1967 | Brauer | 342/6 |
| 3,365,790 | A | * | 1/1968 | Brauer | 342/7 |
| 3,525,566 | A | * | 8/1970 | Altman | 359/530 |
| 3,689,346 | A | * | 9/1972 | Rowland | 156/245 |
| 3,810,804 | A | * | 5/1974 | Rowland | 156/245 |
| 3,811,983 | A | * | 5/1974 | Rowland | 156/245 |
| 3,833,285 | A | * | 9/1974 | Heenan | 359/551 |
| 4,096,479 | A | * | 6/1978 | Van Buskirk | 342/7 |
| 4,612,473 | A | * | 9/1986 | Nilssen | 313/111 |
| 4,618,518 | A | * | 10/1986 | Pricone et al. | 359/530 |

* cited by examiner

*Primary Examiner* — Bernarr Gregory

(74) *Attorney, Agent, or Firm* — Dean A. Craine

(57) ABSTRACT

A conforming radar reflector that includes a thin, metallic reflector layer with a plurality of corner reflectors formed or molded. The shape and orientation of the corner reflectors on the reflector layer produce a strong radar return signal and enable the reflector to bend and conform to the shape of a support object or surface. The corner reflectors are recessed cavities with three converging reflecting surfaces oriented 90 degrees apart from each other and attached at their adjoining edges. Adjacent corner reflectors are rotated and offset approximately 60 degrees. When viewed from the front, six adjacent corner reflectors are aligned in radial pattern each with one vertex pointing to a common center. Disposed between the outer perimeter edges on adjacent corner reflectors is flexible intermediate section that acts as a living hinge that enables the reflector layer to be bent along the intermediate section to conform to an outer surface.

20 Claims, 7 Drawing Sheets

LOW PROFILE CONFORMING RADAR REFLECTOR

This utility patent application is based on and claims the filing date benefit of U.S. provisional patent application (61/645,092) filed on May 10, 2012.

COPYRIGHT NOTICE

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to radar reflectors and more particularly, low profile radar reflectors designed to conform to the shape of any surface.

2. Description of the Related Art

Corner reflectors are commonly used on ships and large boats to reflect radar signals back to a radar source. To be effective, relatively large corner reflectors were used in the prior art to produce strong returns on radar source screens.

A typically corner reflector includes three reflective surfaces oriented 90 degrees apart from each other and attached at their adjoining edges. When an incoming radar wave reaches one of the reflective surfaces, it is reflected to one of the other reflective surfaces and back to source along a path parallel to the incoming radar wave.

To reflect radar waves coming from any direction, multi-directional radar reflectors have been developed. On one version, the radar reflector includes eight corner reflectors placed in a back-to-back arrangement forming an octahedron shape. Because only eight corner reflectors are used, each corner reflector must be relatively large to produce a strong return signal. The overall size of the radar reflector is large and requires rigid structures and surfaces to hold them in a fixed position. Because of their size, they are unsightly and create significant wind resistance or drag. In some instances, they may also interfere with standing and running rigging.

What is needed is a lightweight, low profile radar reflector that produces a strong return signal that can be manufactured in different sizes and flat and curved shapes that enable it to be mounted on different support surfaces.

SUMMARY OF THE INVENTION

At the heart of the invention is the discovery that wood or small watercraft do not produce strong radar wave returns because they are made of materials with low reflective properties. Also, such watercraft is too small to accommodate large radar reflectors currently found in the prior art. Because of these limitations and others, wood or small watercrafts are often involved in collisions at night or in poor visibility conditions because they could not be seen and tracked by radar.

Disclosed herein is a small, low profile radar reflector that produces a strong return signal that can be manufactured or bent to conform to a curved or flat surface on a wood or small watercraft. More specifically, the radar reflector includes a thin, planar reflective layer that includes a plurality of side-by-side corner reflectors formed thereon. The radar reflector may be a single reflective layer is made of relatively thin metal or a composite material with the reflective layer made using a reflective metallic coating applied to the outer surface of the composite material. Alternatively, the radar reflector may be made of composite material with embedded metallic elements. When the radar reflector is made of only the single reflective layer, the corner reflectors are molded or formed in the reflective layer which is mounted directed to a surface or object on the watercraft. When the reflective layer is attached to an intermediate substrate, the intermediate substrate is mounted or attached to the watercraft.

The reflective layer comprises a plurality of three-sided, recessed corner reflectors. Each corner reflector includes three planar converging, reflecting surfaces oriented 90 degrees apart from each other and attached at their adjoining edges. The three planar surfaces on each corner reflector are aligned so their outer perimeter edges (also known as 'legs') are aligned with each other and aligned with the reflective layer's planar axis when horizontally aligned. When viewed from a top plan view, the three outer edges form an equilateral triangle.

Each planar surface includes an inner corner aligned with the center axis of the inside corner of corner reflector. The corner may be opened or closed.

Disposed between the outer perimeter edges on adjacent corner reflectors is flexible intermediate section that acts as a living hinge. In one embodiment, substantially the entire reflective layer is covered with a plurality of corner reflectors that are aligned in alternating offset directions. When viewed, six adjacent corner reflectors are aligned in radial pattern have one vertex pointing to a common center. Because all of the outer perimeter edges on each corner reflector are longitudinally aligned with at least one outer perimeter edge on the six surrounding corner reflectors, each common center is intersected by three axis formed on the reflective layer.

In one embodiment, the reflective layer is a thin, molded or stamped metallic layer and the common centers are located in the flexible intermediate section. The reflective layer may be manually bent long one of the three axis that intersect the common center.

The corner reflectors vary from 1/16 to 1½ inches in width. Because substantially the entire planar surface is covered with side-by-side corner reflectors and because the planar surfaces on each corner reflector are 90 degrees apart, all the corner reflectors on the side of the radar reflector facing the radar source are exposed to an incoming radar wave, and produce a large number of return radar waves that can be detected by the radar source.

Also disclosed is a paddle with a radar reflector attached to its handle.

DESCRIPTION OF THE PREFERRED EMBODIMENT(S)

Figure 1:
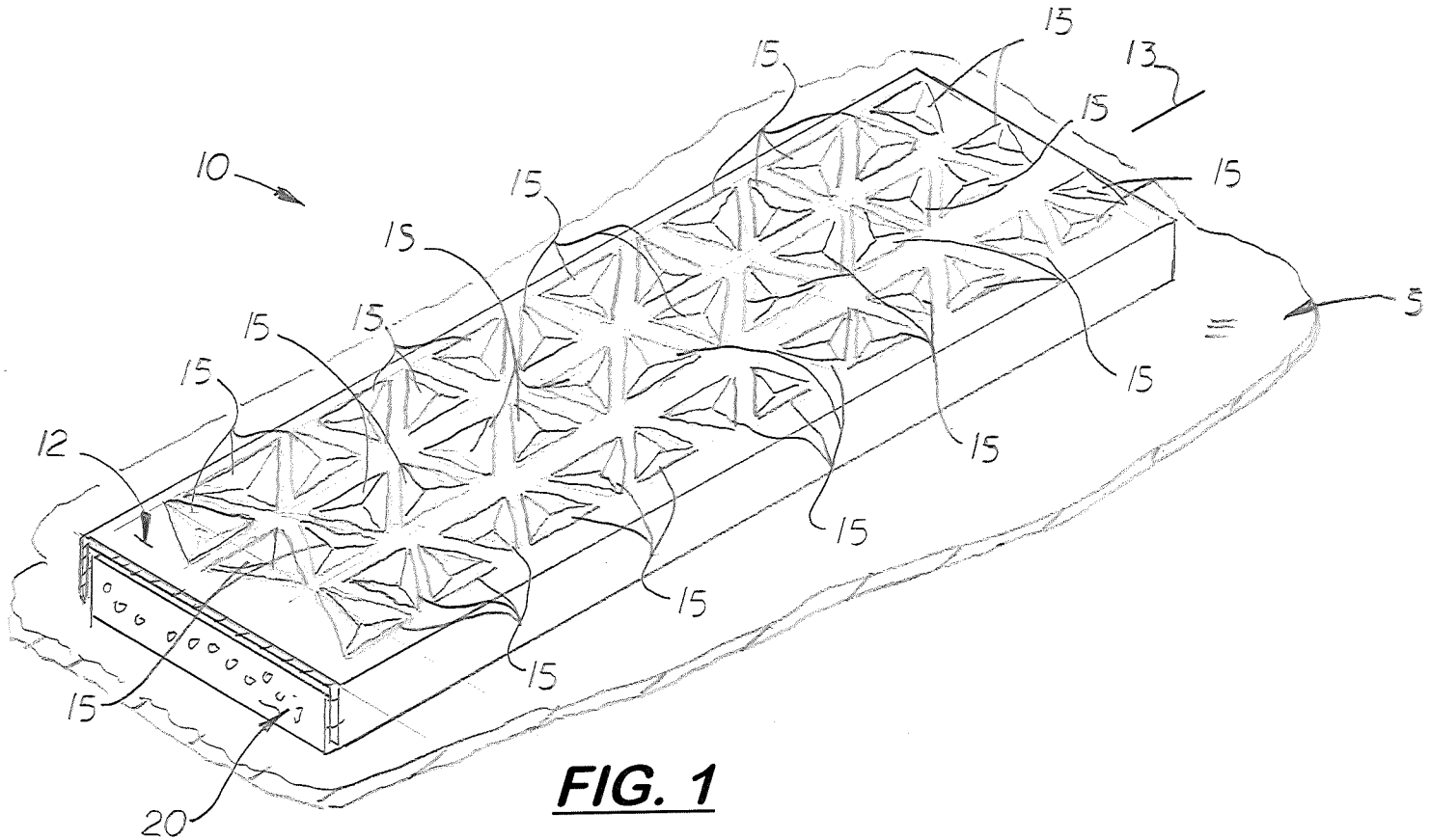
FIG. 1 is a perspective of a section of a low profile, strong return signal producing radar reflector.
Figure 2:
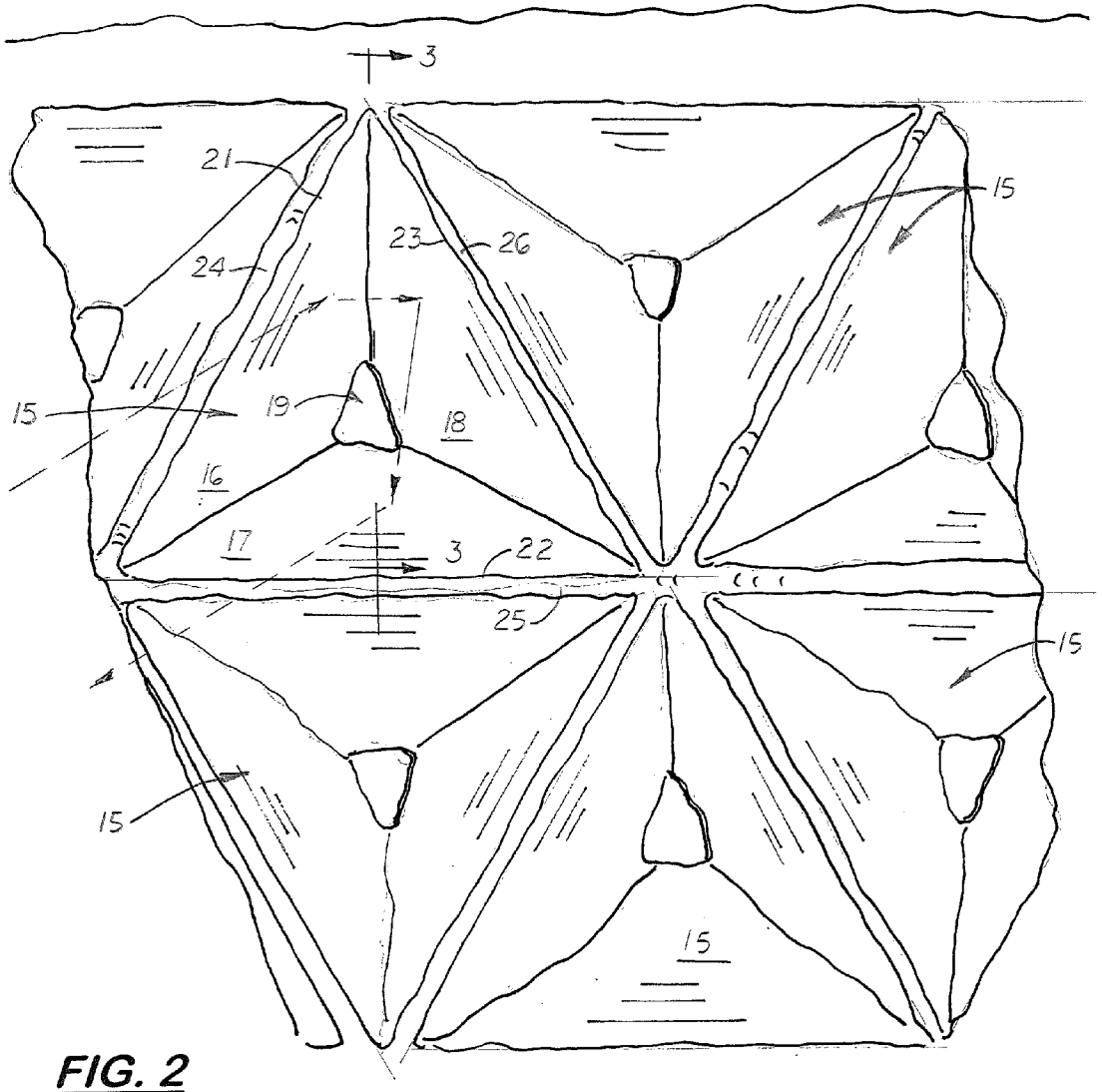
FIG. 2 is a top plan of a section of the radar reflector in FIG. 1.
Figure 3:
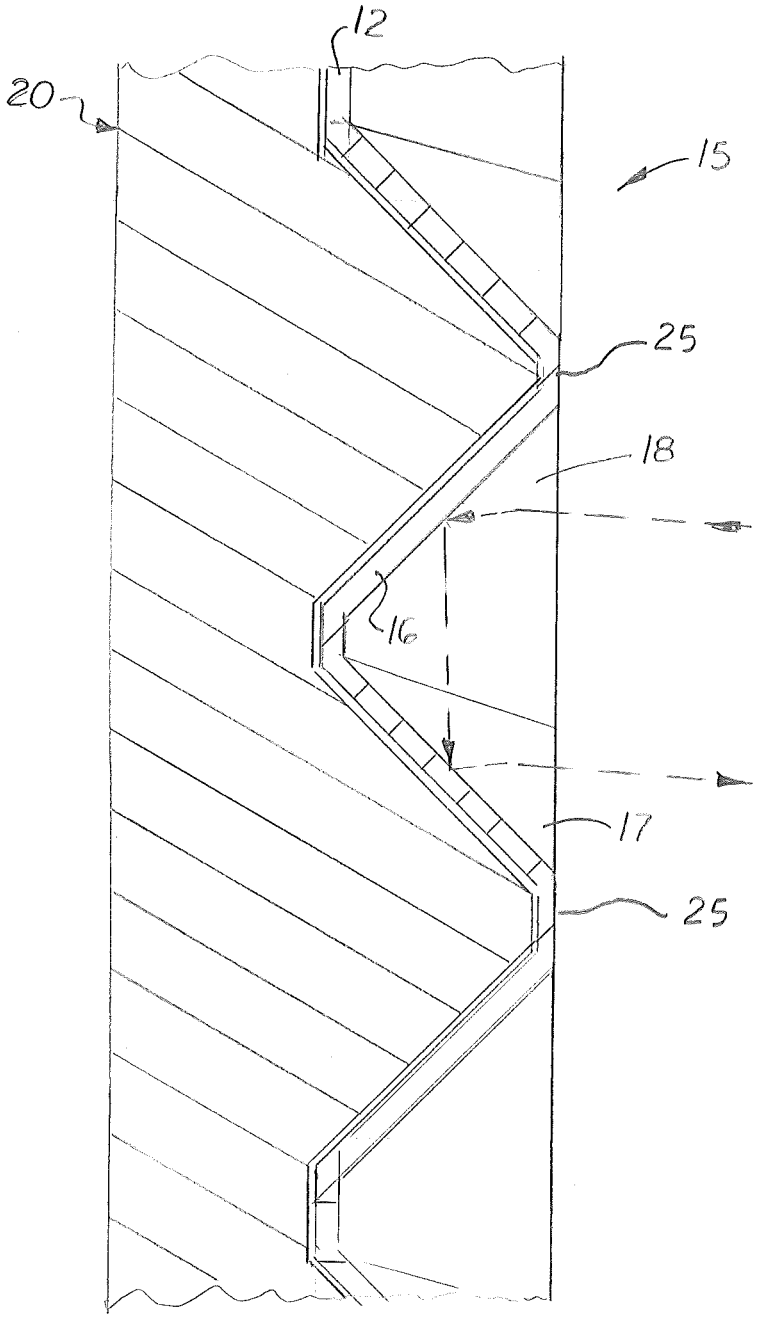
FIG. 3 is a sectional side elevation view of the radar reflector taken along line 3-3 in FIG. 2.

Referring to the accompanying FIGS. 1-6, there is shown a lightweight, low profile radar reflector 10 that includes a thin reflective layer 12 that includes a plurality of side-by-side recessed corner reflectors 15 formed thereon. In one embodiment, the reflective layer 12 is made of relatively thin metallic material configured to reflect a radar wave. The reflective layer 12 may be attached directly to a support surface or structure 5 or mounted or attached to an intermediate substrate 20 that is attached to a desired surface or structure. FIGS. 1 and 3, show the reflective layer 12 mounted on an intermediate substrate, such as foam substrate. In another alternative embodiment the intermediate substrate 20 may be a molded structure made of composite material with void areas formed therein that have the same shape as the corner reflectors 15. A reflective layer 12 may be a liquid paint layer or a coating that is applied to corner reflectors formed in the intermediate substrate 20 to create a radar wave reflecting structure.

As shown more in FIGS. 2 and 3, each corner reflector 15 includes three converging planar surfaces, 16, 17, 18 diagonally aligned approximately 90 degrees apart. Each corner reflector 15 may be closed or may include an optional apex opening 19. The planar surfaces 16, 17, 18 are disposed 90 degrees apart. The three planar surfaces 16, 17, 18 on each corner reflector 115 are aligned so their outer perimeter edges (also known as 'legs') 21, 22, 23, respectively, are aligned with each other and aligned with the reflective layer's planar axis 13 when horizontally aligned as shown in FIG. 1. When viewed from a top plan view, the three outer edges 21, 22, 23 form an equilateral triangle as more clearly shown in FIGS. 2 and 4.

Figure 4:
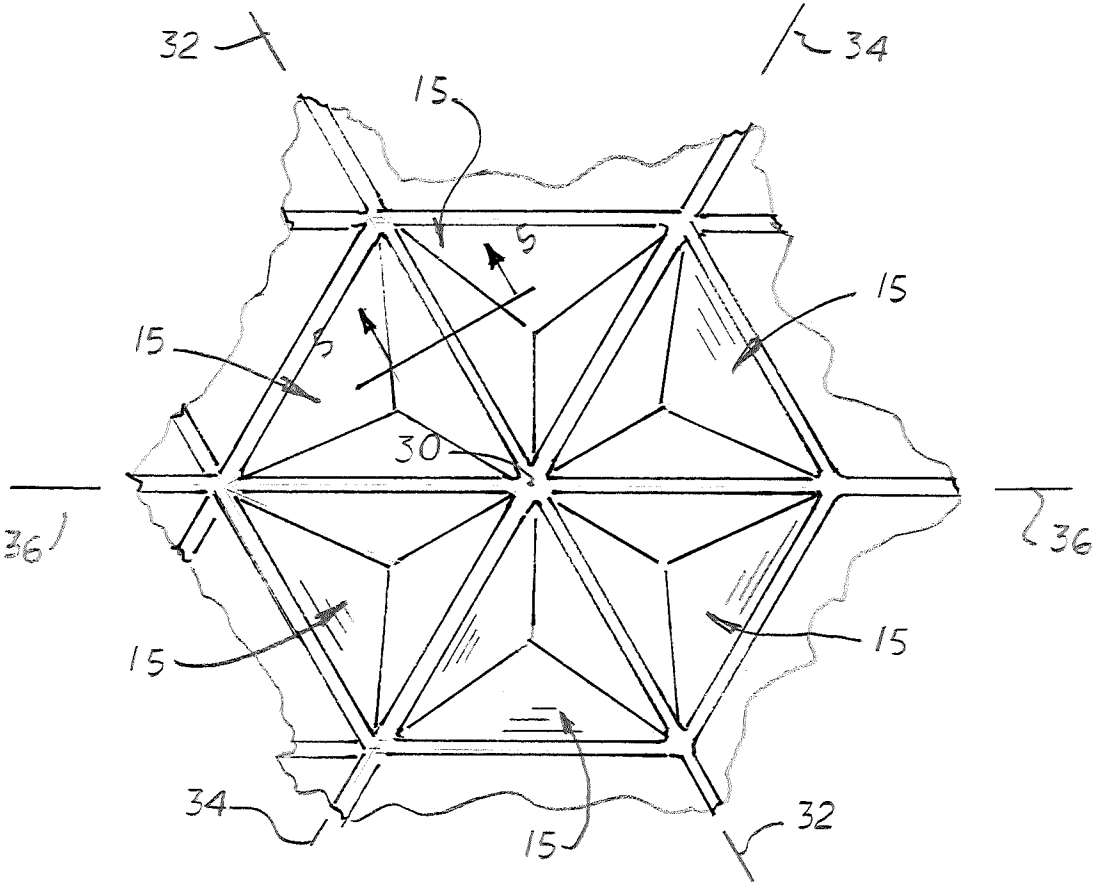
FIG. 4 is a top plan view of the reflector layer.
Figure 5:
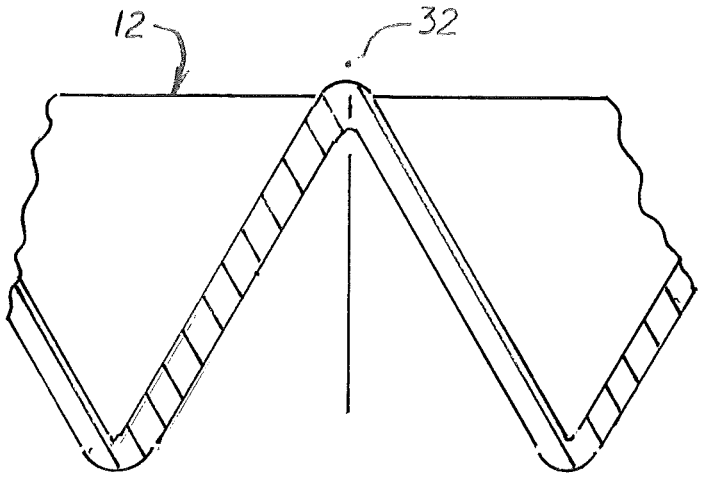
FIG. 5 is a sectional side elevation view of the reflector layer taken along line 5-5 in FIG. 4.
Figure 6:
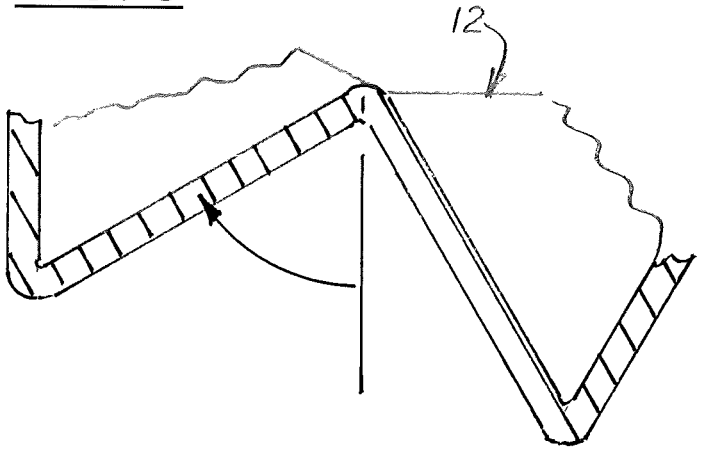
FIG. 6 is a sectional side elevation view of the reflector layer shown in FIG. 5 with the left section of the reflector layer being bent upward.

In one embodiment, substantially the entire reflective layer 12 is covered or molded into a plurality of corner reflectors 15 that are aligned in alternating offset directions as shown in FIGS. 2 and 4. Disposed disposed between the outer perimeter edges 21, 22, 23 on adjacent corner reflectors 15 is a flexible intermediate section 24, 25, 26, respectively that acts as a living hinge. When viewed, six adjacent corner reflectors 15 are aligned in a star, radial pattern each with one vertex pointing to a common center 30. Because all of the outer perimeter edges 21, 22, 23 on each corner reflector 15 are longitudinally aligned with at least one outer perimeter edge on the six surrounding corner reflectors 15, each common center 30 is intersected by three axis 32, 33, 36 formed on the reflective layer 12. When the reflective layer 12 is a thin, molded or stamped metallic layer, it may be bent long one of the three axis 32, 33, 36 that intersect the common center 30 as shown in FIG. 6 to conform to the shape of support structure 5.

Figure 7:
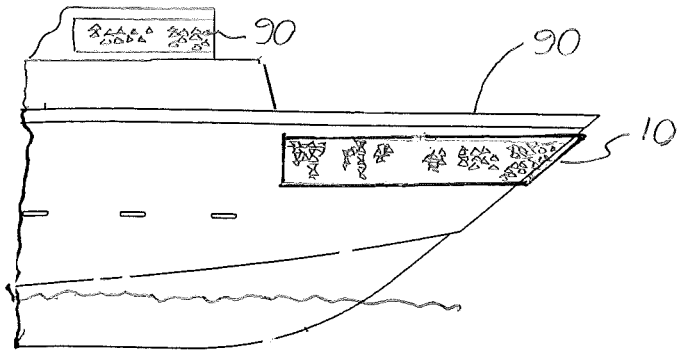
FIG. 7 is a side elevation view of the curved hull of a watercraft showing the radar reflector attached thereto.
Figure 8:
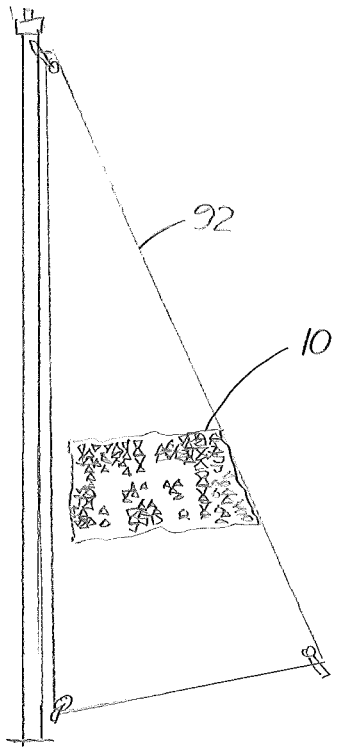
FIG. 8 is a side elevation view of the sail with the radar reflector attached thereto.
Figure 9:
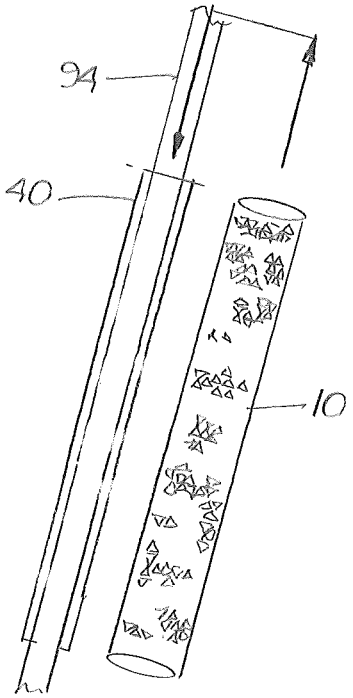
FIG. 9 is a side elevation view of a piece of rigging with a rigid support tube attached to the rigging and a cylindrical shaped radar reflector attached over inside the support tube.

It should be understood that the radar reflector 10 can be manufactured in any size and shape and use different sizes of corner reflector sizes. Preferable, the corner reflectors 15 should be 1/16 to 3 inches across. The depth of each corner reflector 15 is approximately equal to one half the distance across the corner reflector 15. The intermediate sections 24, 25, 26 are 1/16 to one-half inch wide. In some instances, however, the corner reflectors 15 y may be larger. It should be understood however, the larger size of corner reflectors 15 the ability to bend the reflective layer 12 around a substrate surface is reduced. Therefore, when larger corner reflectors 15 are used, the radar reflector 10 typically uses an molded intermediate substrate 20 on which the reflective layer 12 is mounted or applied When the reflective layer 12 is made of thin metallic material, it can be easily bent and conform to any surface. As stated above, the reflective layer 12 may also be a liguid covering applied to an intermediate substrate with corner reflective voids or cavities formed thereon. FIGS. 7-10 show different surfaces or objects on which the reflector 10 may be attached or mounted. For example, FIG. 7 is a side elevation view of a curved hull 90 of a watercraft showing the radar reflector 10 attached thereto. FIG. 8 is a side elevation view of the sail 92 with the shape conforming radar reflector 10 attached thereto. FIG. 9 is a side elevational view of a piece of rigging 94 with an optional rigid support tube 40 attached to the rigging 94 and the cylindrical shaped radar reflector 10 attached over inside the support tube 40.

Figure 10:
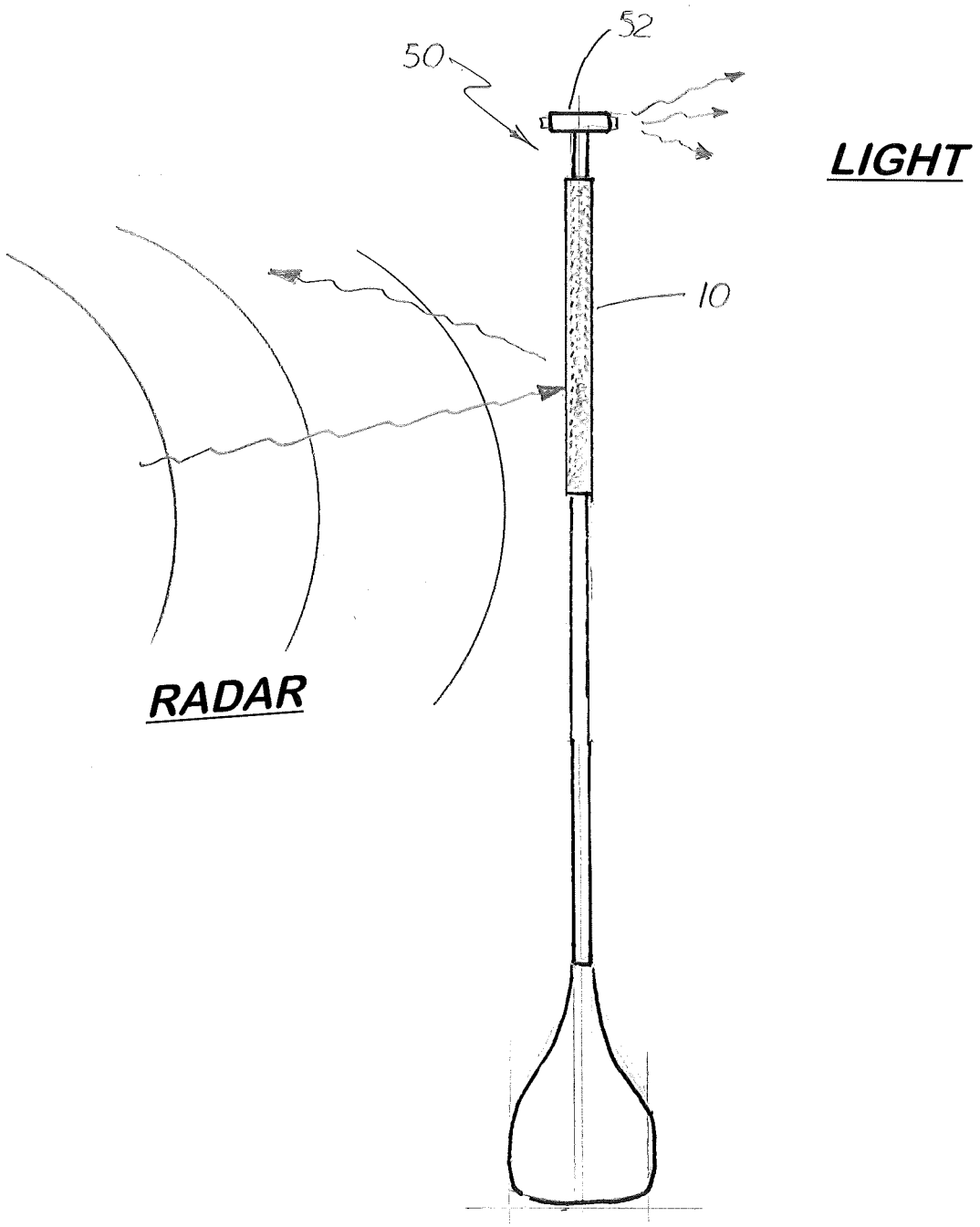
FIG. 10 is a front elevational view of a paddle with the radar reflector wrapped around the handle.

FIG. 10 is a front elevational view of a paddle 50 with a cylindrical shaped radar reflector 10 extended around the upper section of the handle 60.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A radar reflector, comprising:

a reflective layer that includes a plurality of side-by-side recessed corner reflectors, thereon, each said corner reflector includes three converging, reflecting surfaces oriented 90 degrees apart from each other, each said corner reflector being oriented 60 degrees from an adjacent corner reflector so that all of said reflecting surface on each said corner reflector is aligned with a reflecting surface on an adjacent said corner reflector.

2. The radar reflector, as recited in claim 1, wherein said reflective layer is made of thin metallic material.

3. The radar reflector, as recited in claim 2, wherein each corner reflector is between 0.16 to 0.5 inches across.

4. The radar reflector, as recited in claim 1, further including said reflective layer mounted on a substrate.

5. The radar reflector, as recited in claim 1, wherein is a reflective layer is a metallic covering applied to a substrate.

6. The radar reflector, as recited in claim 5, wherein each corner reflector is between 0.16 to 0.5 inches across.

7. The radar reflector, as recited in claim 1, wherein each corner reflector includes a perimeter edge that is separated from the perimeter edge formed on an adjacent said corner reflector by an intermediate section.

8. The radar reflector, as recited in claim 7, wherein said reflector layer is a thin, flexible metallic layer.

9. The radar reflector, as recited in claim 8, further including said reflective layer mounted on a substrate.

10. The radar reflector, as recited in claim 7, further including said reflective layer mounted on a substrate.

11. The radar reflector, as recited in claim 7, wherein each corner reflector is between 0.16 to 0.5 inches across.

12. The radar reflector, as recited in claim 1, wherein each corner reflector is between 0.16 to 0.5 inches across.

13. A radar reflector, comprising:

a reflective layer that includes a plurality of side-by-side recessed corner reflectors, each said corner reflector includes three converging, reflecting surfaces oriented 90 degrees apart from each other, said corner reflector has an equilateral triangular opening with three perimeter edges, each said corner reflector being oriented on said reflective layer with its three said perimeter edges are parallel with said the perimeter edges on an three adjacent said corner reflectors.

14. The radar reflector, as recited in claim 13, wherein each corner reflector is between 1/16 to 3 inches across.

15. The radar reflector, as recited in claim 13, wherein said reflective layer is made of thin metal that reflects a radar wave.

16. The radar reflector, as recited in claim 15, wherein each corner reflector is between 1/16 to 3 inches across.

17. The radar reflector, as recited in claim 13, further including said reflective layer mounted on a substrate.

18. The radar reflector, as recited in claim 17, wherein each corner reflector is between 1/16 to 3 inches across.

19. The radar reflector, as recited in claim 13, wherein is a reflective layer is a metallic covering applied to a substrate.

20. The radar reflector, as recited in claim 19, wherein each corner reflector is between 1/16 to 3 inches across.

* * * * *